US012104369B2

(12) United States Patent
Bass et al.

(10) Patent No.: US 12,104,369 B2
(45) Date of Patent: Oct. 1, 2024

(54) JOIST POCKET ASSEMBLY FOR A REFRIGERATED FACILITY

(71) Applicant: Cold Summit Development LLC, Ketchum, ID (US)

(72) Inventors: Aaron Bass, Ketchum, ID (US); Mike Smith, Ketchum, ID (US); Scott Pertel, Ketchum, ID (US); Alex Langerman, Ketchum, ID (US)

(73) Assignee: Cold Summit Development LLC, Ketchum, ID (US)

( * ) Notice: Subject to any disclaimer, the term of this patent is extended or adjusted under 35 U.S.C. 154(b) by 129 days.

(21) Appl. No.: 17/863,286

(22) Filed: Jul. 12, 2022

(65) Prior Publication Data

US 2024/0018772 A1 Jan. 18, 2024

(51) Int. Cl.

| | |
|---|---|
| ***E04B 1/41*** | (2006.01) |
| ***E04B 1/76*** | (2006.01) |
| ***E04B 5/10*** | (2006.01) |

(52) U.S. Cl.

CPC ..... *E04B 1/4114* (2013.01); *E04B 1/76* (2013.01); *E04B 5/10* (2013.01); *E04B 2001/7679* (2013.01)

(58) Field of Classification Search

None

See application file for complete search history.

(56) References Cited

U.S. PATENT DOCUMENTS

| | | | | |
|---|---|---|---|---|
| 1,468,100 A * | 9/1923 | Baldwin | ..... | E04B 1/08 52/11 |
| 1,769,564 A | 7/1930 | Wynkoop | | |
| 2,176,450 A | 10/1939 | Barnett | | |
| 2,871,692 A | 2/1959 | Marter | | |
| 4,275,541 A * | 6/1981 | Orals | ..... | E04B 5/10 52/745.15 |

(Continued)

FOREIGN PATENT DOCUMENTS

| | | |
|---|---|---|
| EP | 0070770 A1 | 1/1983 |
| EP | 1148180 A1 | 10/2001 |

(Continued)

OTHER PUBLICATIONS

International Search Report and Written Opinion for International Patent Application No. PCT/US2023/70070, dated Nov. 6, 2023.

*Primary Examiner* — Joshua K Ihezie

(74) *Attorney, Agent, or Firm* — Goodwin Procter LLP

(57) ABSTRACT

A joist pocket assembly and a method for manufacturing a joist pocket assembly is described herein. In some embodiments, the joist pocket assembly can include a frame configured to be mounted within a cut-out in a wall. In some embodiments, the joist pocket assembly can include a base of the frame, where the base can be configured to receive a structural member of a joist. In some embodiments, the joist pocket assembly can include a flange extending from a perimeter of the frame, where the flange can cover a gap between the frame and the wall. In some embodiments, the joist pocket assembly can include a first stud coupled to the base of the frame, where the first stud can secure the frame to the wall. In some embodiments, the joist pocket assembly can be placed in a concrete tilt wall or concrete precast wall.

14 Claims, 8 Drawing Sheets

(56) References Cited

U.S. PATENT DOCUMENTS

| | | | | | |
|---|---|---|---|---|---|
| 4,294,050 | A * | 10/1981 | Kandel | E04C 3/42 | 52/93.2 |
| 5,590,505 | A * | 1/1997 | Bogle | E04C 3/292 | 52/836 |
| 5,761,873 | A * | 6/1998 | Slater | E04B 2/62 | 52/696 |
| 10,150,235 | B1 * | 12/2018 | O'Donnell | B29C 44/1219 | |
| 10,422,141 | B1 * | 9/2019 | Harkins | E04B 7/00 | |
| 10,724,231 | B1 * | 7/2020 | Treville | E04B 1/76 | |
| 2002/0005022 | A1 * | 1/2002 | Matthews | E04B 5/10 | 52/696 |
| 2004/0255551 | A1 * | 12/2004 | Fuhr | E04F 15/02183 | 52/782.1 |
| 2006/0236627 | A1 * | 10/2006 | Messenger | E04B 1/04 | 52/272 |
| 2021/0293020 | A1 * | 9/2021 | Burt | E04B 1/2403 | |
| 2021/0340760 | A1 * | 11/2021 | Burt | E04B 5/10 | |
| 2022/0034078 | A1 | 2/2022 | Karius et al. | | |

FOREIGN PATENT DOCUMENTS

| | | | |
|---|---|---|---|
| GB | 1362564 | A | 8/1974 |
| GB | 2459935 | A | 11/2009 |

* cited by examiner

JOIST POCKET ASSEMBLY FOR A REFRIGERATED FACILITY

TECHNICAL FIELD

The present disclosure relates generally to the joist mounting and insulation assemblies for installation in refrigerated facilities, and more specifically a joist pocket assembly for use in a refrigerated facility.

BACKGROUND

Refrigerated facilities require sufficient temperature control, thermal insulation and a moisture barrier to properly manage the temperature of their internal environment. It can be critical to properly secure, mount and insulate particular structural components of a refrigerated facility to allow for the necessary temperature control, and manage cooling within the refrigerated environment. Refrigerated facilities may use an internal structural frame where the vapor barrier and insulation encloses, or are installed, on the exterior of structural frames or portions of the refrigerated facility. Furthermore, insulating such structural features can require significant detail work, such as for example, at each a joist-wall intersection of the refrigerated facility, to properly seal and insulate the facility.

SUMMARY

A joist pocket assembly is presented. In some embodiments, the joist pocket assembly, can include a frame configured to be mounted within a cut-out in a wall. In some embodiments, the joist pocket assembly can include a base of the frame, where the base can be configured to receive a structural member of a joist. In some embodiments, the joist pocket assembly can include a flange extending from a perimeter of the frame, where the flange can cover a gap between the frame and the wall. In some embodiments, the joist pocket assembly can include a first stud coupled to the base of the frame, where the first stud can secure the frame to the wall.

Various embodiments of the joist pocket assembly can include one or more of the following features. In some embodiments, the joist pocket assembly can be configured to provide a continuous moisture and/or vapor barrier between the end of the joist and the joist pocket assembly. In some embodiments, the wall, e.g., the wall including a cut-out where the frame can be mounted and/or installed, can be part of a refrigerated facility. In some embodiments, the joist pocket assembly can include a second stud coupled to the bottom of the base, where the second stud can secure the frame to the wall. In some embodiments, the flange can extend approximately 2 inches from the perimeter of the frame. In some embodiments, the frame can include a shape of at least one of a square, rectangle, circle, triangle, or polygon. In some embodiments, the joist pocket assembly can include an insulation layer disposed on an outside portion of the frame, where the insulation layer can be located between the frame and the wall. In some embodiments, the insulation layer can include at least one of a rigid polyiso foam, extruded polystyrene (XPS), expanded polystyrene (EPS), sprayable polyurethane, and/or polyisocyanurate. In some embodiments, the joist pocket assembly can include an insulation fill disposed within an opening in the frame, where the insulation fill can fill around the end of the joist. In some embodiments, the insulation fill can include a foam-in-place insulation material. In some embodiments, the joist pocket assembly can include an insulated metal panel coupled to the joist pocket assembly, where the insulated metal panel can be adjacent to the wall. In some embodiments, the joist pocket assembly can include an insulation fill disposed between the joist pocket assembly, the insulated metal panel and the wall. In some embodiments, the joist pocket assembly can include a wall membrane disposed between the joist pocket assembly, the insulated metal panel and the wall. In some embodiments, the joist pocket assembly can include a sealant disposed between the joist pocket assembly, the wall and the wall membrane, where the sealant can bond the wall membrane to the joist pocket assembly and the wall. In some embodiments, the sealant can include a butyl sealant.

A method of manufacturing a joist pocket assembly, is presented. In some embodiments, the method of manufacturing a joist pocket assembly can include providing a frame configured to be within a wall. In some embodiments, the method of manufacturing a joist pocket assembly can include providing a base of the frame, where the base is configured to receive a structural member of a joist. In some embodiments, the method of manufacturing a joist pocket assembly can include forming a flange extending from a perimeter of the frame, where the flange can cover a gap between the frame and the wall. In some embodiments, the method of manufacturing a joist pocket assembly can include coupling a first stud to the base of the frame, where the first stud can secure the frame to the wall. In some embodiments, the wall can be part of a refrigerated facility. In some embodiments, the method of manufacturing a joist pocket assembly can include coupling a second stud to the base of the frame, where the second stud can secure the frame to the wall. In some embodiments, the method of manufacturing a joist pocket assembly can include coupling an insulation layer to an outside portion of the frame. In some embodiments, coupling the insulation layer can include coupling at least one of a rigid polyiso foam, extruded polystyrene (XPS), expanded polystyrene (EPS), sprayable polyurethane, or polyisocyanurat to an outside portion of the frame.

A joist pocket assembly is presented. In some embodiments, the joist pocket assembly can include a frame configured to be mounted within a cut-out within a wall, where the frame can be in a shape of a square. In some embodiments, the joist pocket assembly can include an opening in the frame, where the opening can be configured to receive a structural member of a joist. In some embodiments, the joist pocket assembly can include a base of the frame, where the base can be configured to receive the structural member of the joist. In some embodiments, the joist pocket assembly can include a flange extending from a perimeter of the frame, where the flange can cover a gap between the frame and the wall. In some embodiments, the joist pocket assembly can include a plurality of studs coupled to the base of the frame, where the plurality of studs can secure the frame to the wall.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the systems and methods described herein. In the following description, various embodiments are described with reference to the following drawings.

Figure 1:
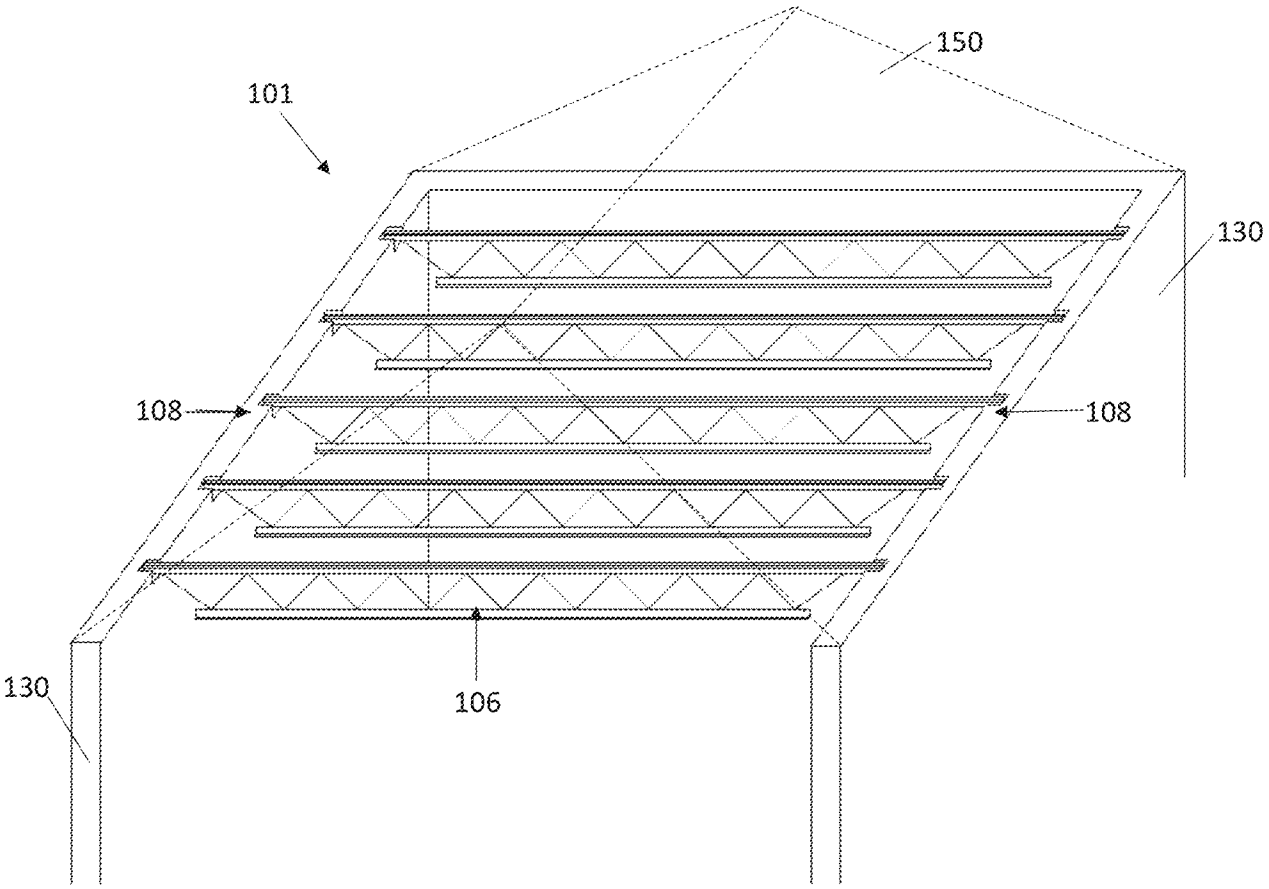
FIG. 1 illustrates a refrigerated facility, according to some embodiments.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

A joist pocket assembly for use in a refrigerated facility is disclosed. In some embodiment, the joist pocket assembly can include a frame configured to be mounted within a corresponding cut-out or cast in a wall of a refrigerated facility. In some embodiments, the joist pocket assembly can include a base of the frame, where the base is configured to receive one end of an upper bar (e.g., a structural member) of a joist. In some embodiments, the joist pocket assembly can include a flange extending from a perimeter of the frame, where the flange can cover a gap between the frame and the wall. In some embodiments, the joist pocket assembly can include at least one stud coupled to the base of the frame, where the stud can secure the frame to the wall. The joist pocket assembly presented herein can address challenges in effectively maintaining temperature control, moisture barrier, vapor barrier, and thermal insulation, as discussed above, and reduce and/or eliminate the time for detail work used for sealing at and around the joist and wall intersection. In some embodiments, the joist pocket assembly can be configured to provide a continuous moisture and/or vapor barrier between the end of the joist and the joist pocket assembly.

Overview of Environmental Control for a Refrigerated Facility

A refrigerated facility can require sufficient environmental control to effectively manage the temperature of the refrigerated facility's internal environment. Such environmental control can include temperature control, inclusion of a vapor barrier, a moisture barrier and/or thermal insulation. In some examples, air that is cooled within the refrigerated facility can hold considerably less water vapor than air outside. This can be due to the refrigeration process used within the refrigerated facility, which can include removing moisture by heating evaporator coils, e.g., of a refrigeration unit, and draining the moisture out of a cold space, e.g., the area of lowest temperature within the refrigerated facility. The refrigeration process can happen multiple times a day, drying out the air within the cold space. Furthermore, water vapor and/or other gasses making up the air from outside of the facility, e.g., outside air, can give rise to air pressure known as atmospheric pressure. The water vapor of the outside air, which can be of a higher vapor pressure, can tend to drive or migrate to an area of lower vapor pressure, i.e. within the cold space of the refrigerated facility. As this vapor (which is now inside the refrigerated facility) is cooled it will condense, and if freezing temperatures are present the condensation and/or water vapor will turn to ice. In some examples, the ice can buildup and affect a cold envelope of the refrigerated facility, such as weakening the refrigerated facility's thermal resistance of the insulation (e.g., r-value), and increasing demand for the refrigeration equipment to remove heat from the refrigerated facility itself. In some examples, the ice buildup can increase the power consumption and/or maintenance performed on the refrigeration equipment. Also, in some examples, ice can cause structural damage, e.g., including heaving and/or delamination, as the ice pushes against the external surfaces of the refrigerated facility, including the roof, walls and slab. Therefore, it can be beneficial for a refrigerated facility to use one or more of the structures described herein to provide for an effective thermal insulation, vapor barrier, moisture barrier and/or a cold envelope for the refrigerated facility. In some embodiments, the cold envelope for the refrigerated facility can also be referred to herein as a cold storage envelope. Furthermore, in some examples, because of complex thermal transfer dynamics, a structural tilt wall and/or precast wall may not be used for low temperature warehouses. Thus, the embodiments described herein can enable the use of tilt-wall and/or precast wall in place of a structural frame. Additionally, in one example, most refrigerated facility construction can make use of a structural frame which is internal, and thus may not require substantial detail work. In some examples, significant detail work can be preferred when a refrigerated facility has a structural frame which is external. Such refrigerated facilities that, in some examples, have an external structural frame, may therefore benefit from the joist pocket assembly and/or embodiments presented herein.

In some embodiments, a vapor barrier can include a material which is used to prevent and/or slow the transfer of water vapor across external surfaces of a refrigerated facility. In some examples, the vapor barrier can be used to prevent and/or slow the transfer of water vapor across a cold envelope of the refrigerated facility, e.g., the cold envelope including walls, a roof and/or slab of the refrigerated facility. In some examples, vapor barriers can include a roofing membrane material, one or more insulated metal panels and/or an under floor material. In some embodiments, the cold envelope can be formed by one or more vapor barriers. In some examples, sealants, adhesives and/or any other type of bonding materials, can be used to bond multiple vapor barriers together, e.g., forming a cold envelope.

Referring to FIG. 1, a refrigerated facility is presented, according to some embodiments. As shown, the refrigerated facility 101 can include a roof 150, one or more walls 130 and one or more joists 106 mounted on the walls 130 to allow for mounting of the roof 150 to the refrigerated facility 101. In some examples, the walls 130 can include a tilt-wall and/or a precast wall construction. In one example, most refrigerated facilities can use an internal structural frame, where the vapor barrier and insulation can enclose, or can be installed on, the exterior of the internal structural frames (e.g., the walls 130). In some examples, the refrigerated facility 101 can include one or more joists 106 secured between at least two walls 130, where a joist 106 can be secured and/or mounted to the walls 130 at joist mount locations 108. As shown, at least two joist mount locations 108 can be used to mount one joist 106 between two walls 130. In some embodiments, it is at the joist mount locations 108 where effective thermal insulation, moisture barrier, and/or vapor barriers are can be most beneficial to support maintaining environmental control and/or temperature control of the refrigerated facility 101. For example, an adequate vapor barrier at the joist mount locations 108 can prevent the release of cold air, and entry of hot air into the refrigerated facility 101. In one example, maintaining an adequate moisture barrier at the joist mount locations 108 can prevent condensation and prevent resulting ice formation which can affect the refrigerated facility's cold envelope, e.g., including weakening the refrigerated facility's thermal resistance. In some examples, the release of cold air, entry of hot air, entry water vapor, and potential ice formation can be through gaps or holes at the joist mount locations 108 of the refrigerated facility 101. In a particular example, a conventional refrigerated facility having a typical tilt-wall can include a weak point, where structural joists meet the supporting wall e.g., a point of potential thermal insulation loss and/or weakening of the cold envelope. Such a configuration can require significant detail work at each joist 106 and wall 130 intersection (e.g., joist mount locations 108) to properly seal and insulate the refrigerated facility 101. Thus, in a construction for a refrigerated facility, a potential point refrigeration leak, thermal insulation loss, and/or penetration of the moisture barrier and vapor barrier, can include locations where structural features meet, e.g., at joist mount locations 108. An exemplary joist, mounted on a joist mount location, is described in more detail in FIG. 2 below.

Figure 2:
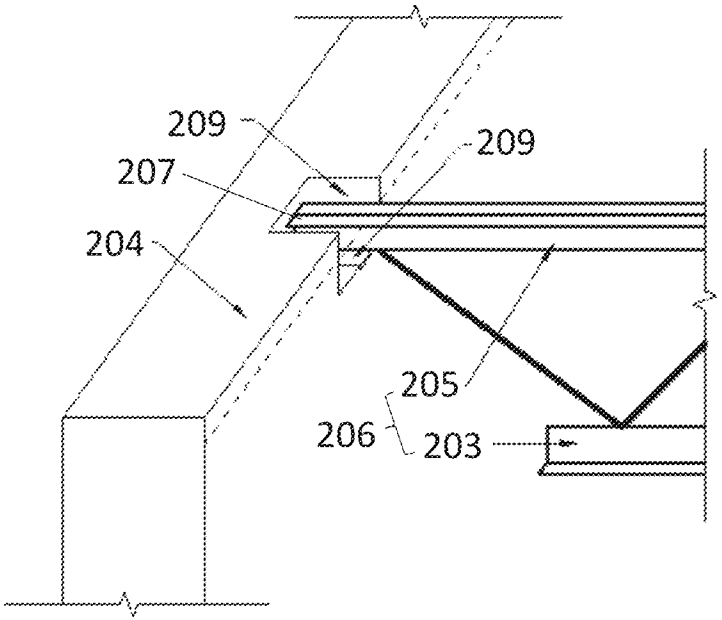
FIG. 2 illustrates a joist bracket, according to some embodiments.

Referring to FIG. 2, an exemplary joist mounted on a joist mount location is presented, according to some embodiments. In some examples, the joist 206 can include a lower bar 203 and an upper bar 205. In some examples, and end of the lower bar 203 and/or an upper bar 205 of the joist 206 can be referred to as structural members. As shown in FIG. 2, the joist 206 can be mounted to a wall 204 via the joist mount location 209. In some examples, the joist mount location 209 can include a cut-out of the wall 204, e.g., as shown in FIG. 2. In one example, the joist mount location 209 can include a joist bearing pocket, e.g., the cut-out portion of the wall. In some examples, as shown, one end 207 of the upper bar 205 of the joist 206 can be located within the joist beating pocket. In some examples, the joist bearing pocket can allow for potential thermal insulation loss. For example, the cut-out region and/or exposed region of the joist bearing pocket can allow for loss of cold air, and entry of hot air. The joist bearing pocket can also allow for moisture barrier and/or vapor barrier penetration. In an example, the joist bearing pocket can allow for condensation and/or ice formation starting at the at the end 207 of the upper bar 205 of the joist 206, e.g., where the joist 206 meets the wall 204. In one example, the vapor barrier can be penetrated by each joist 206 as it bears onto the wall 204, and reliance on further detailing can be critical. In some examples, the colder the temperatures are in the cold space of the refrigerated facility, the more risk there is for water vapor loss due to a compromised and/or penetrated vapor barrier at the joist beating pocket. Furthermore, other joist mount solutions make use of substantially insulating exposed portions such as the joist bearing pocket, which can require significant detail work at each joist-wall intersection to properly seal and insulate the facility.

Thus, one or more exemplary joist pocket assemblies is presented herein to address the challenges of maintaining environmental control within a refrigerated facility, described above.

Joist Pocket Assembly

One or more joist pocket assemblies are described herein that can be configured to prevent thermal insulation loss of a refrigerated facility. Also, the one or more joist pocket assemblies described herein can be configured to prevent the penetration of a moisture barrier and/or a vapor barrier of the refrigerated facility. These and other exemplary joist pocket assemblies are described in further detail below.

Figure 3B:
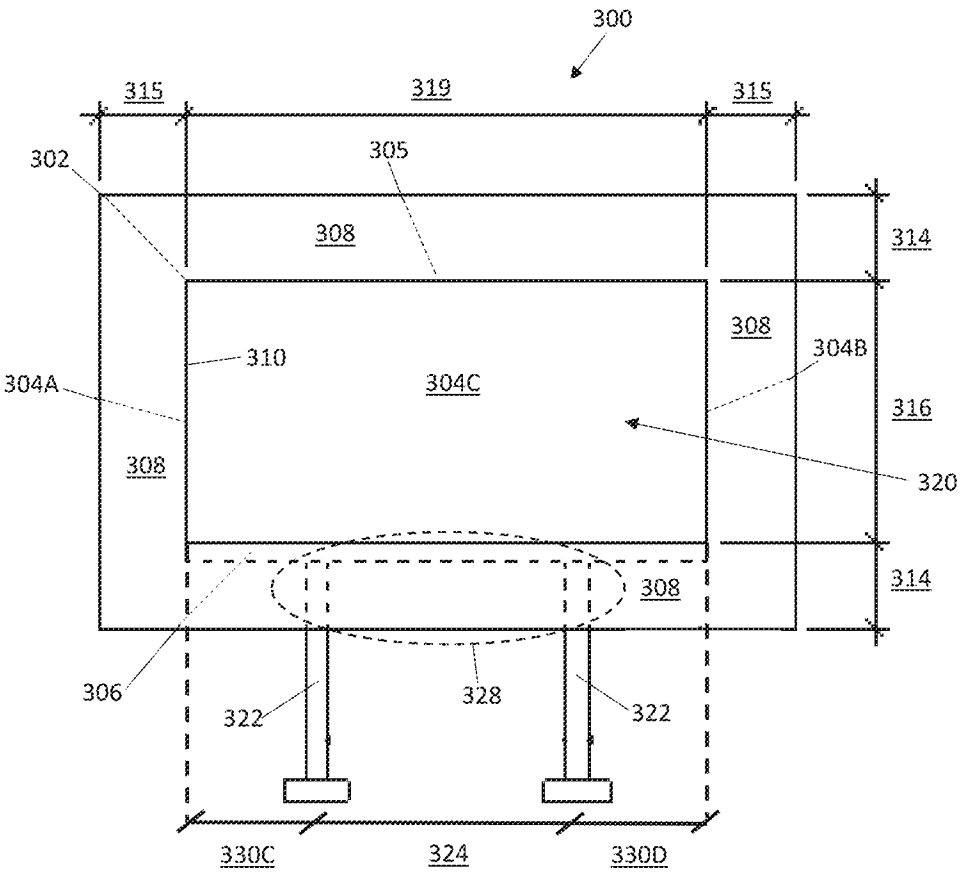
FIG. 3B illustrates a front view of a joist pocket assembly, according to some embodiments.
Figure 3A:
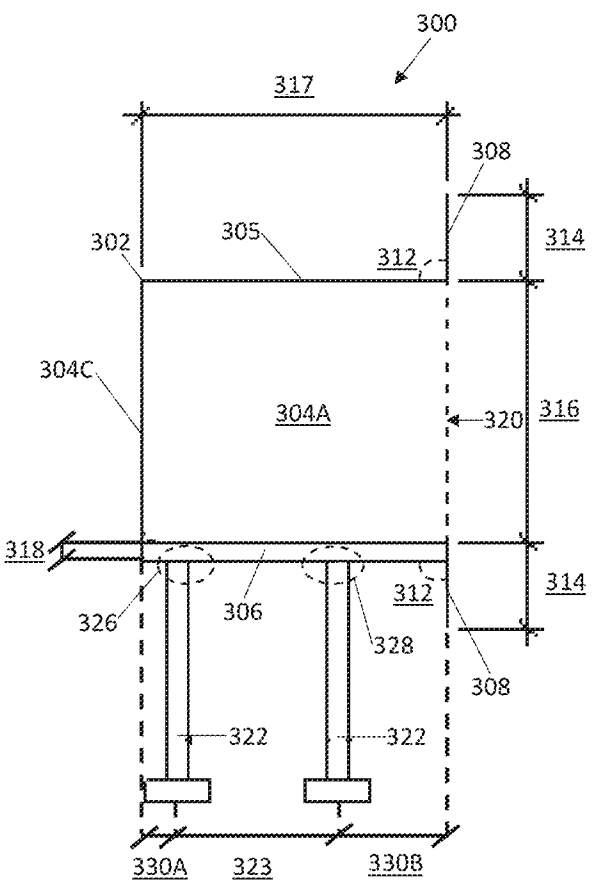
FIG. 3A illustrates a cross-sectional view of a joist pocket assembly, according to some embodiments.

A joist pocket assembly for use in a refrigerated facility is described herein. FIGS. 3A and 3B present exemplary configurations for a joist pocket assembly. Although an exemplary joist pocket assembly is disclosed, this application is not limited to the joist pocket assembly presented, and various configurations can be used or implemented accordingly.

Referring to FIGS. 3A and 3B, a side view and a front view of a joist pocket assembly are shown respectively, according to some embodiments. In some embodiments, the joist pocket assembly 300 can include a frame 302. In some embodiments, the frame 302 can be in a shape of a square, as shown. In some embodiments, although the frame 302 is shown to be in the shape of a square, other shapes can be used. In some examples, the frame 302 can be in the shape of a square, rectangle, circle, triangle, polygon and/or any other applicable shape that can be used. In some embodiments, the frame 302 can be configured to prevent vapor from entering or leaving through the frame 302. In some examples, the frame 302 can be vapor tight and/or provide for a tight seal to prevent any vapor from escaping or entering through the joist pocket assembly 300. In some embodiments, the frame 302 can include one or more walls 304. In some examples, the walls 304 can include a first wall 304A, second wall 304B and a third wall 304C, e.g., as shown in FIG. 3A and FIG. 3B, As used herein, the walls 304 can refer to the first wall 304A, second wall 304B and third wall 304C together. In some examples, the frame 302 can include three or more walls 304. In some embodiments, the first wall 304A and the second wall 304B can have a height of a first distance 316 and a width of a second distance 317. In some embodiments, the third wall 304C can have a height of the first distance 316 and a width of a third distance 319. In some examples, the first distance 316 can be approximately equal to the second distance 317. In one example, the first and second distances 316, 317 can both be approximately 6 inches. In some examples, the first distance 316 can have a different distance from the second distance 317. In an example, the first distance 316 can be approximately 6 inches and/or the second distance 317 can be approximately 7 inches. Similarly, in some examples, the first distance 316, second distance 317 and third distance 319 can be approximately equal, or each have a different distance. In some examples, the third distance 319 can be approximately twice the first and/or second distances 316, 317. In one example, the third distance 319 can be approximately 14 inches. In some embodiments, the frame 302 can include a top portion 305 and a base 306. In some embodiments, the top portion 305 can have a width of the third distance 319 and a length of the second distance 317. In some embodiments, the base 306 can include a thickness 318. In some examples, the thickness 318 of the base 306 can be approximately ½ of an inch. In some examples, the base can have approximately the same or similar dimensions as the top portion 305.

Referring to again FIGS. 3A and 3B, according to some embodiments, the joist pocket assembly 300 can include a flange 308 extending from a perimeter 310 of the frame 302, where the perimeter can include one or more sides. In some examples, as shown in FIG. 3B, the flange 308 can extend from all sides of the perimeter 310. In one example, the flange 308 can extend from a side, e.g., one side, of the perimeter 310. In another example, the frame 302 can extend from two or more sides of the perimeter 310. In some embodiments, the flange 308 can be at an angle 312 from the frame 302. In an example, the angle 312 between the flange 308 and the frame 302 can be approximately 90 degrees. In some embodiments, the flange 308 can extend from the perimeter 310 by a first length 314 and/or a second length 315. In one example, the first length 314 can be approximately equal to the second length 315. In an example, the first and second length 314, 315 can be approximately 2 inches. In some examples, the first length 314 can have a different length from the second length 315. In some embodiments, the flange 308 can cover a gap and/or void between the frame 302 and a wall of the refrigerated facility. In some embodiments, the frame 302 can include be a galvanized frame, e.g., the frame 302, can include a galvanized steel frame. In some embodiments, the flange 302 can be located along approximately the same plane as the wall of the refrigerated facility. In some examples, the flange 308 located along approximately the same plane as the wall can allow for a vapor barrier and the wall to be installed without any additional projections.

Referring to again FIGS. 3A and 3B, according to some embodiments, one or more studs 322 can be attached to the base 306 of the frame 302. In some examples, the one or more studs 322 can be coupled to the base 306 of the frame 302. In some embodiments, the studs 322 can be welded and/or glued to the base 306 of the frame 302. In one example, the studs 322 can be screwed into the base 306 of the frame 302. In some examples, four studs 322 can be attached to the base 306 of the frame 302. In some embodiments, each stud 322 can be a distance 323 and/or 324 from each other stud 322. In some examples, the distances 323, 324 can be approximately 6 inches. In some embodiments, each stud 322 can be placed approximately equidistant, e.g., the distances 323, 324 can be the approximately the same between studs 322. In another example, the studs 322 can all have different distances between individual studs. In some examples, a pair of studs 322, e.g., two studs, can be used. In some embodiments, at least one stud 322 can be attached to a first location 326 and/or a second location 328 of the base 306 of the frame 302, e.g., referring to the first location 326 and second location 328 shown in FIGS. 3A and 3B. In some examples, a pair of studs 322 can be coupled to the first location 326 and another pair of studs 322 coupled to the second location 328 of the base 306 of the frame 302. In another example, one stud 322 can be coupled to the first location 326 and another stud 322 can be coupled to the second location 328 of the base 306 of the frame 302. In some examples, various configurations can be used such as two studs 322 can be coupled to the second location 328 and one stud 322 can be coupled to the first location 326, and vice versa. In some embodiments, studs 322 can be placed on one or more walls 304 and/or the base 306 of the frame 302. In some examples, some studs 322 can be placed on the walls 304 and other studs 322 can be placed on the base 306 of the frame 302. In some embodiments, one or more studs 322 can be an offset distance 330 from at least one edge of one wall 304. In some examples, the offset distance 330 can be used to describe a first offset distance 330A, a second offset distance 3308, a third offset distance 330C, and a fourth offset distance 330D collectively together. In some examples, the first offset distance 300A, the second offset distance 330B, the third offset distance 330C, and the fourth offset distance 330D can all be approximately equal. In one example, the first offset distance 330A, the second offset distance 330B, the third offset distance 330C, and the fourth offset distance 330D can all have a distance of approximately 3 inches. In some examples, the second offset distance 330B, the third offset distance 330C, and the fourth offset distance 330D can all be approximately equal. In some examples, the first offset distance 330A, the second offset distance 330B, the third offset distance 330C, and the fourth offset distance 330D can have a different distance from each other offset distance. In an example, the offset distance 330A can be less than the offset distances 330B, 330C and 330D. In some examples, the second offset distance 330B can be configured to offset one or more studs 322 into the concrete wall to allow for a concrete coverage between the wall and the joist pocket assembly. In the example of the second offset distance 330B, such a concrete coverage can include a 3 inch concrete coverage. In some examples, the studs 422 can be approximately 6 inches long. In one example, the studs 322 can include nelson studs. As used herein, the studs 322 can be referred to as a first stud, second stud, and so on (e.g., the first stud a separate and/or different stud from the second stud). In some embodiments, the studs 322 can include galvanized studs. In some embodiments, the joist pocket assembly 300 can be configured for welded and/or bolted connection to the wall. In some examples, the joist pocket assembly 300 can include a welded and/or bolted connection.

Referring yet again FIGS. 3A and 3B, according to some embodiments, the joist pocket assembly can include an opening. In some examples, the walls 302 and the base 306 can form the opening 320, e.g., as shown in FIGS. 3A and 3B. In some embodiments, the joist pocket assembly 300 can be configured to receive a structural member, e.g., an end of the upper bar 205 shown in FIG. 2. In some examples, and as used herein, a structural member can be used to describe an end of the upper bar of a joist. In one example, the end of a joist, such as the end of the upper bar 205 can be referred to as a joist tail and/or a tail. In some examples, the opening 320 can be large enough to allow for the structural member to fit through the opening. In some examples, the structural member can fit into the opening 320 and sit on the base 306 of the frame 302. In one example, the opening 320 can be filled with insulation material, as also described below.

In various embodiments, one or more joist pocket assemblies are described herein. As shown, like reference numbers used for features described can be used to represent the same or similar features. For example, the joist pocket assembly 300 described in FIGS. 3A and 3B can be the same or similar to the joist pocket assembly 400 described in FIGS. 4A, and 4B, below. Therefore, the description for like numbers used to describe the joist pocket assembly 300 in FIGS. 3A and 3B can be used to describe the joist pocket assembly 400 described in FIGS. 4A and 4B, below. In one example, the frame 302 described in FIGS. 3A and 3B can refer to the same or similar frame 402 described in FIGS. 4A and 4B. In another example, FIGS. 4A, 4B and 5 each show a refrigerated facility 401 and 501 each having its own joist pocket assembly 434 and 534, respectively. The description for each of the features having like reference numbers used in FIGS. 4A, 4B and 5 can be, in some example, used to represent the same or similar features shown. Therefore, in an example, the joist 534 of FIG. 5 can refer to the same or similar joist 434 shown and described in FIGS. 4A and 4B.

Figure 4A:
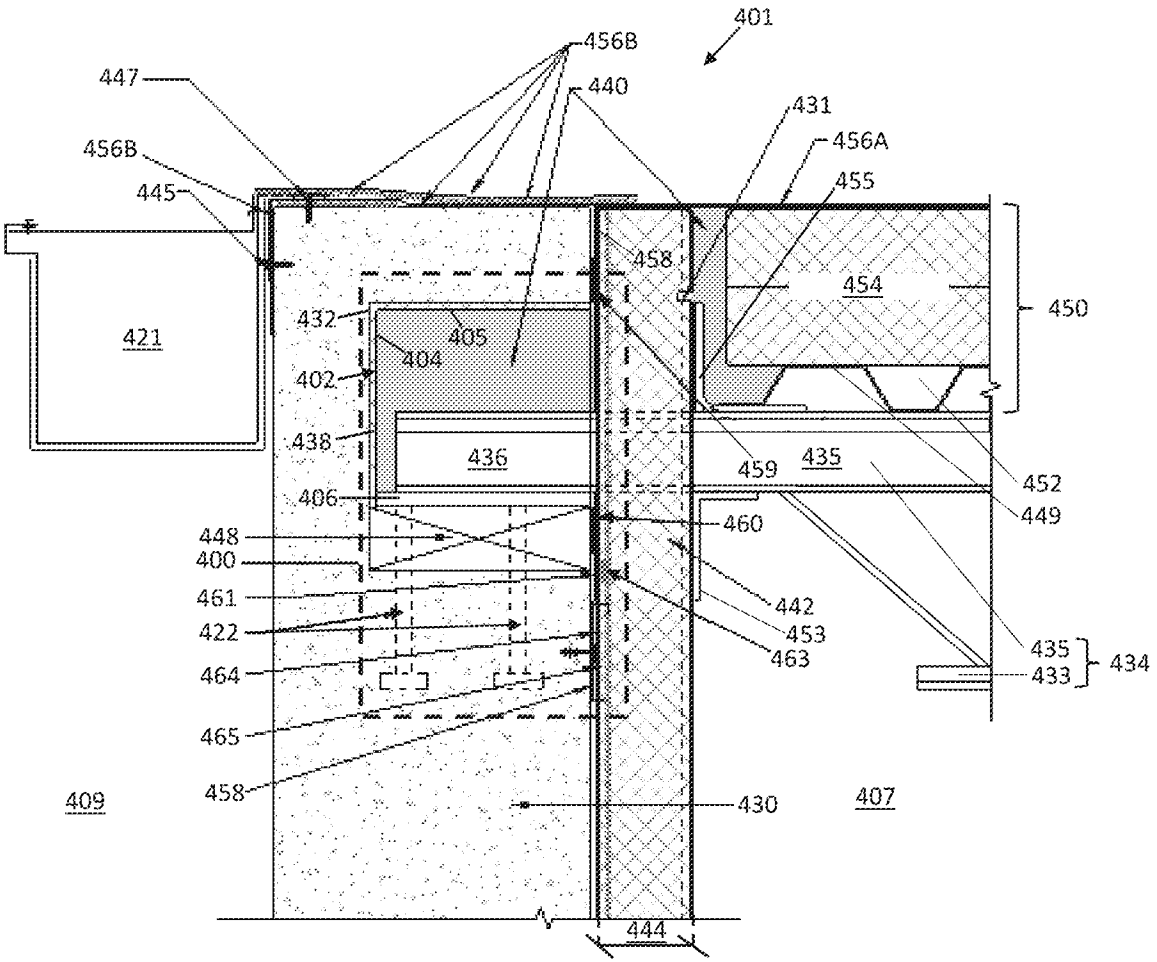
FIG. 4A illustrates a cross-sectional view of a joist pocket assembly in a refrigerated facility, according to some embodiments.
Figure 4B:
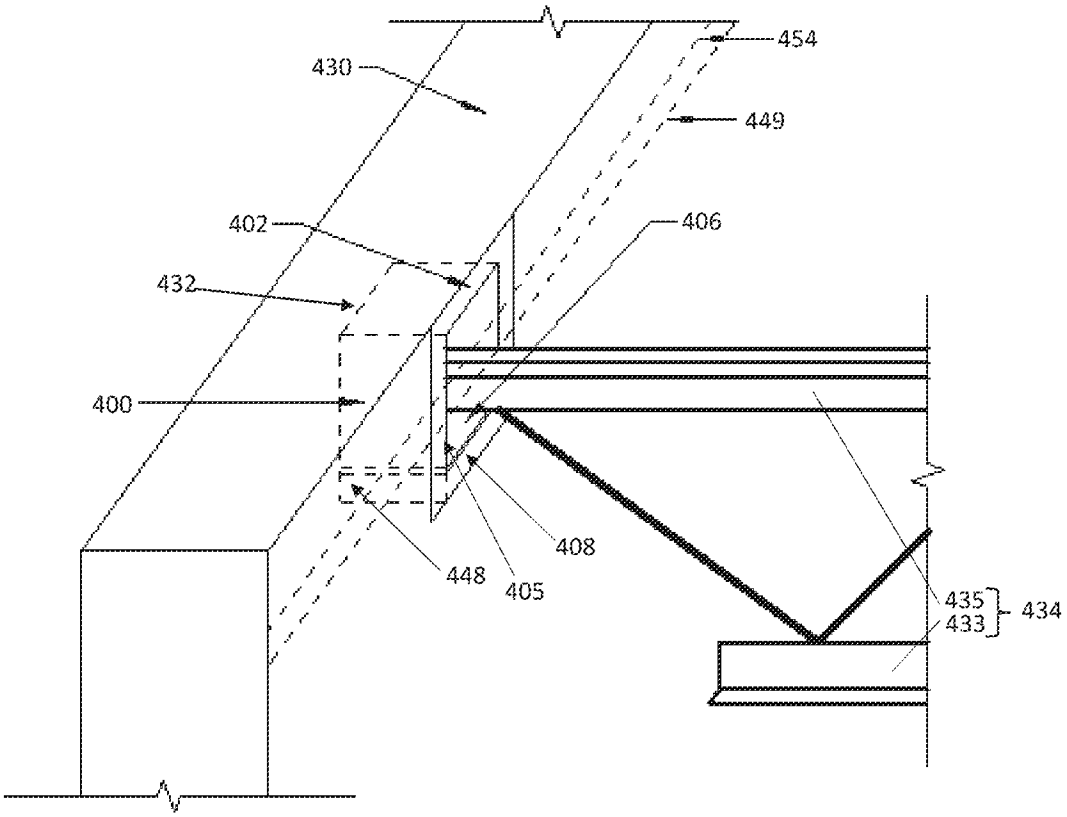
FIG. 4B illustrates an exemplary joist pocket assembly in a refrigerated facility, according to some embodiments.

Referring to FIGS. 4A and 4B, a cross-sectional view of a joist pocket assembly in a refrigerated facility is presented, according to some embodiments. As shown, the refrigerated facility can include an enclosed region 407 and be surrounded by an outside region, e.g., ambient environment 409. In some examples, the refrigerated facility 401 can be configured maintain environment control and/or temperature control within the enclosed region 407. In some examples, the refrigerated facility 401 can be configured to prevent heat from entering the enclosed region 407. In some examples, the refrigerated facility 401 can be configured to prevent moisture and/or vapor from entering and/or leaving the enclosed region 407. In some embodiments, the refrigerated facility 401 can include at least one wall 430 and a roof 450. In some examples, the wall 430 can include concrete. In one example, the wall 430 can be formed by pouring concrete into a mold that includes a cut-out portion 432 for the joist pocket assembly 400, where the wall can be later on lifted and fit into place (e.g., in a tilt-wall application). In one example, the roof 450 can include steel and/or insulation material. In some embodiments, and as shown in FIGS. 4A and 4B, the refrigerated facility 401 can include a joist 434. In some examples, the joist 434 can include a lower bar 433 and an upper bar 435. As used herein, the lower bar 433 and/or upper bar 435 can be referred a structural members. In some examples, structural member can also be used to refer to an end of the lower bar 433 and/or upper bar 435. In some embodiments, the roof 450 can be mounted onto the wall 430 via at least one end 436 of the upper bar 435 placed inside the joist pocket assembly 400, as shown. In some embodiments, the roof 450 can include a steel frame (e.g., upper bar 453 of one or more joists) and/or a metal deck 449. Although one end 436 of the upper bar 435 (e.g., of the joist 434), and one joist pocket assembly 400 are shown, one or more joists and joist pocket assemblies can be used. For example, similar to that shown at 108 in FIG. 1, another joist pocket assembly can be installed within another wall on an opposite end of the refrigerated facility to receive an opposite end of the upper bar 435 of the joist 434 shown in FIGS. 4A and 4B (e.g., referring to the opposite locations 108 in 1). In some embodiments, the end 436 of the upper bar 435 can sit on a base 406 of a frame 402. In some embodiments, the refrigerated facility 401 can include a gutter 421. In some examples, the gutter 421 can include support braces.

Referring again to FIGS. 4A and 4B, in some embodiments, the joist pocket assembly 400 can be placed within a cut-out portion 432 in (e.g., within) the wall 430 of the refrigerated facility 401. In some examples, the cut-out portion 432 of the wall 430 can be in a shape of a square and/or cube. In some embodiments, the cut-out portion 432 can be in the same shape and/or size as the frame 402 of the joist pocket assembly 400. In some examples, the frame 402 can sit inside the cut-out portion 432 and directly contact the wall 430. In some examples, a flange 408 can extend from a perimeter 405 of the frame 402. In one example, the cut-out portion 432 of the wall 430 can be in a shape configured to receive the joist pocket assembly 400. In the same example, the cut-out portion 432 of the wall 430 can have the same or similar dimensions as the frame 402. In some examples, the cut-out portion 432 of the wall 430 and the frame 402 of the joist pocket assembly 400 can both be in the shape of a square and/or cube. In some embodiments, the cut-out portion 432 of the wall 430 can be in the shape of a square, rectangle, circle, triangle, polygon and/or any other applicable shape (e.g., any similar and/or corresponding shape of the frame 402). In some embodiments, the joist pocket assembly 400 can be secured to the wall 430 via one or more studs 422. In some embodiments, a bearing block 448 can be located beneath the joist pocket assembly 400. In some examples, the bearing block 448 can be located within the cut-out portion of the wall 430. In some examples, the bearing block 448 can be cast into the wall 430 while the walls is being made. In some examples, the wall 430 can be formed by pouring concrete into a mold where the bearing block 448 can be within the mold such that when the wall 430 is created, the bearing block 448 can be formed into the wall 430. In the same example, the bearing block 448 can be formed into the wall 430 beneath the cut-out portion 432. In some examples, the bearing block 448 can include a polyurethane among other materials, e.g., the bearing block 448 can be a polyurethane bearing block. In some embodiments, the joist pocket assembly 400 can be placed in a concrete tilt wall or concrete precast wall.

Referring yet again to FIGS. 4A and 4B, in some embodiments, the joist pocket assembly 400 can include one or more insulation materials. In some examples, the joist pocket assembly 400 can be lined with a first insulation material 438 around the outside of the frame 402, e.g., between the frame 402 and the wall 430. In some examples, the first insulation material 438 can be referred to as a thermal break material. In one example, the first insulation material 438 and the bearing block 448 can include the same insulation material, e.g., polyurethane among other materials. In an example, the first insulation material 438 can be located lining the cut-out portion 432 of the wall 430, e.g., placed between the frame 402 and the wall 430. In some examples, the first insulation material 438 can also include rigid polyiso foam, extruded polystyrene (XPS), expanded polystyrene (EPS), sprayable polyurethane, polyisocyanurate, foam sealant, spray foam sealant, spray foam, polyurethane foam, foam-in-place insulation among other foams, sealants and/or materials. In some embodiments, the joist pocket assembly 400 can be filled with a second insulation material 440 within the inside of the frame 402. In some embodiments, the second insulation material 440 can also be used to fill gaps and/or voids located between the roof 450, joist pocket assembly 400 and the insulated metal panel 442 as shown in FIGS. 4A and 4B. In some embodiments, as shown, the second insulation material 440 can fill spaces and/or voids around the end 436 of the upper bar 435 and within the frame 402. In some embodiments the second insulation material 440 can include one or more of the same materials described above for the first insulation material 438, among other materials. In some embodiments, the first and/or second insulation materials 438, 440 can include different materials from each other insulation material, e.g., the first insulation materials 438 includes a different material from the second insulation material 440. In some embodiments, the first and/or second insulation materials 438, 440 can be referred to as an insulation layer and/or insulation fill. In some embodiments, the first and/or second insulation materials 438, 440 are not used. In some examples, the frame 402 can sit inside the cut-out portion of the wall 430 and directly contact the wall 430, e.g., the first insulation 438 is not used.

Referring again to FIGS. 4A and 4B, in some embodiments, an insulated metal panel 442 can be placed between the wall 430 and the inside of the refrigerated facility 401. In some embodiments, the insulated metal panel 442 can be configured to provide thermal insulation between the wall 430 and the inside of the refrigerated facility 401. In some examples, the insulated metal panel 442 can have a thickness 444 of approximately 5 inches. In some embodiments, the joist pocket assembly 400 can be configured to allow the insulated metal panel 442 to be mounted adjacent to the end 436 of the joist 434, allowing for a tight, e.g., air tight, thermal seal between the insulated metal panel 442 and the joist pocket assembly 400. In some embodiments, installing the insulated metal panel 442 in this way can eliminate the requirement to cut an insulated metal panel in the field, and install the insulated metal panel through the roof 450. In some embodiments, a metal trim can be placed onto the insulated metal panel 442. In some examples, the metal trim can be secured to the metal 442 panel and the joist 434. In some examples, the metal trim can be configured to provide a moisture and/or vapor barrier at locations where the insulated metal panel 442 and the joist 434 are in contact. In some examples, the metal trim can also be configured to provide a thermal insulation at locations where the insulated metal panel 442 and the joist 434, e.g., at the upper bar 435, are in contact. In some embodiments, the insulated metal panel 442 can include a field cut thermal break fill 431 having a sealant. Although an insulated metal panel is described and used herein, in some embodiments, a metal panel can be used which may or may not include insulation.

In some embodiments, the joist pocket assembly 400 can be configured to provide a moisture and/or vapor barrier for the refrigerated facility 401. In some examples, the joist pocket assembly 400 can be configured to keep moisture and/or vapor behind the end 436 of the upper bar 435, e.g., preventing moisture and/or vapor from escaping from the refrigerated facility 401. In some examples, the joist pocket assembly 400 can be configured to provide a vapor barrier and/or a moisture barrier that can be located around and/or surrounding the end 436 of the upper bar 435. In some examples, having the joist pocket assembly 400 fit inside the cut-out portion 432 wall 430, the end 436 of upper bar 435 sit inside the joist pocket assembly 400, and/or using one or more of the first and/or second insulation materials 438, 440 to insulate around and/or inside of the frame 402, can provide for a moisture and/or vapor barrier to be located within the joist pocket assembly 400 and around the end 436 of the upper bar 435. In some examples, the joist pocket assembly 400 can be configured allow the moisture barrier and/or the vapor barrier to be installed between the joist pocket assembly 400 and the end of the upper bar (e.g., structural member) such that the moisture barrier and/or vapor barrier is continuous, e.g., it is air tight, there are no gaps and/or holes in the moisture barrier and/or vapor barrier. In contrast, other refrigerated facilities having a joist bracket installation can have voids and/or gaps at the joist mounting point, allowing for moisture and/or vapor loss at the joist mount itself (e.g., referring to FIG. 2). In an example, other refrigerated facilities that do not make use of the joist pocket assembly 400 may experience condensation at the joist mounting point, where the condensation can eventually freeze and form ice that can potentially substantially damage the structure or contents of the refrigerated facility. Furthermore, using the joist pocket assembly 400 can eliminate the often difficult and time-consuming detail work used for sealing around a joist bracket and at the joist mount (e.g., an example of which is shown in FIG. 2). In some embodiments, the joist pocket assembly 400 can be installed in a general use-type facility, e.g., installed in a non-refrigerated facility. For example, the joist pocket assembly 400 can be installed without a first and/or second insulation material 438, 440 in a facility which may not yet require any and/or substantial environmental control. In some examples, if there is a decision to convert the non-refrigerated facility into a refrigerated facility, the first and/or second insulation materials 438, 440 can then be applied. In some embodiments, the joist pocket assembly 400 can be configured to allow for environmental and/or temperature control specific portions of a facility; e.g., is not limited to use for environmental and/or temperature control for an entire floor area of the facility. In an example, a facility using one or more joist pocket assemblies described herein can install one or more joist pocket assemblies in specific rooms and/or floor areas to maintain environmental and/or temperature control within those specific rooms. Thus, using the joist pocket assembly 400 and configuration described herein (e.g., a facility having such a joist pocket assembly 400 installed) can provide an effective approach for converting a non-refrigerated facility to a refrigerated facility, or allowing for portions of a non-refrigerated facility to be converted for environmental/temperature control. Furthermore; using one or more joist pocket assemblies in a facility can provide for a larger amount of the space to be refrigerated in the facility as compared to other methods that do not make use of the joist pocket assemblies described herein.

Referring again to FIGS. 4A and 4B, in some embodiments, the roof can include one or more components for securing and insulating the roof. In some embodiments, the roof 450 can include a roof deck 452 disposed over the joist 434. In some embodiments, the roof deck 452 can include metal (e.g., a metal roof deck). In some embodiments, the roof 450 can include a roof insulation 454 disposed over the roof deck 452, In some examples, the roof insulation 454 can include a multi-layer insulation material, among other roof insulation materials. In some embodiments, the roof insulation 454 can be placed over the wall 430, insulated metal panel 442 and insulation material 440. In some embodiments, a metal trim 453 can be used to cover the insulated metal panel 442, a portion of the roof deck 452 and/or the joist bracket 434, as shown in FIG. 4. In one example, the metal trim 453 can be cosmetic, e.g., used to visually hide the insulated metal panel 442, the portion of the roof deck 452 shown, and/or the joist bracket 434. In some examples, the metal trim 453 can be bent, e.g., bent at approximately 90 degrees. In some embodiments, a metal plate 455 can be used to structurally secure the roof deck 452 and the joist bracket 434, as shown in FIG. 4. In one example, the metal plate 455 can also be bent approximately 90 degrees.

Referring again to FIGS. 4A and 4B, in some embodiments, the roof 450 can include a roof membrane 456. In some embodiments, the roof membrane 456 can be disposed over the roof insulation 454, insulation material 440, the insulated metal panel 442, the wall 430 and/or the joist pocket assembly 400. As used herein, the roof membrane 456 can collectively refer to one or more roof membranes, e.g., a first roof membrane 456A and/or a second roof membrane 456B. In some examples, the first roof membrane 456A can be tightly secured to and/or in intimate contact with the roof insulation 454, insulation material 440, the insulated metal panel 442 and the wall 430. In some examples the second roof membrane 456B can be disposed over a top portion and a side of the wall 430, as shown in FIG. 4A. In one example, the second roof membrane 456B can be adhered to one or more exterior faces of the wall 430. In some embodiments, the roof membrane 456 can include plastic, polyvinyl chloride (PVC), ethylene propylene diene monomer (EPDM) and/or thermoplastic. In some embodiments, the roof membrane 456 can include thermoplastic polyolefin (TPO). In an example, the roof membrane 456 can be a continuous layer (e.g., a continuous layer of plastic) disposed over the roof insulation 454, insulation material 440, the insulated metal panel 442, the wall 430 and the joist pocket assembly 400. In some embodiments, the roof membrane 456 can be include a single layer and/or include multiple layers (e.g., a single and/or multi-layer plastic). In some embodiments, the roof membrane 456 can be mechanically fastened 447, adhered and/or bonded 445 to or over the refrigerated facility 401. In an example, as shown in FIG. 4A, the second roof membrane 456B can be mechanically coupled via a fastener 447 to the wall 430 of the refrigerated facility 401. In an example, as shown in FIG. 4A, the second roof membrane 456B can be bonded and/or secured to the wall 430 of the refrigerated facility 401 via a bonding material 445, e.g., using a butyl tape, a double bead of butyl tape, among other materials. In some embodiments, hot air welding can be used to mechanically fasten, adhere and/or bond the roof membrane 456 to the roof of the refrigerated facility. In an example, hot air welding can be used to mechanically fasten, adhere and/or bond the first roof membrane 456A to the roof insulation 454, insulation material 440, the insulated metal panel 442, and/or the wall 430. In some embodiments, the roof membrane 456 can include a sealant. In some examples, the first and/or second roof membranes 456A, 456B can include a sealant. As used herein, the first and/or second roof membranes 456A, 456B can refer to the same and/or similar roof membrane described herein. In some examples, the sealant can be used at cut edges and terminations where the roof membrane 456 transitions direction, e.g., where the roof membrane 456 ties into the wall 430.

Referring still again to FIGS. 4A and 4B, in some embodiments, the refrigerated facility can include a wall membrane. In some embodiments, the wall membrane 458 can be disposed between the joist pocket assembly 400, the wall 430 and the insulated metal panel 442. In some embodiments, the wall membrane 458 can be a continuous layer extending from the roof membrane 456. In an example, the wall membrane 458 can continuously extend from the roof membrane 458 and be disposed over the insulated metal panel 442, roof insulation 454, insulation material 440, and further disposed between the joist pocket assembly 400, the wall 430 and the insulated metal panel 442. In some examples, portions of the wall membrane 458 can be located between the joist pocket assembly 400, the wall 430 and the insulated metal panel 442. In some examples, the roof membrane 456 and/or wall membrane 458 can be formed as a continuous layer and/or subsequently cut into separate portions and/or strips, e.g., both the roof membrane 456 and wall membrane 458 can be cut from the same material. In some examples, the wall membrane 458 can be secured and/or sealed between the joist pocket assembly 400 and the insulated metal panel 442, e.g., placed in intimate contact between the joist pocket assembly 400 and the insulated metal panel 442. In some examples, a fastener 463 can be used to bond and/or tightly seal the wall membrane 458 to the wall 430 and/or the joist pocket assembly 400. In a particular example, a concrete fastener can be used to bond and/or tightly seal the wall membrane 458 to the wall 430 and/or the joist pocket assembly 400. In some examples, a liner clip 464 can be used to bond and/or tightly seal the wall membrane 458 to the wall 430 and/or the joist pocket assembly 400. In a particular example, a 16 gauge liner clip can be used to bond and/or tightly seal the wall membrane 458 to the wall 430 and/or the joist pocket assembly 400. In some embodiments, one or more bonding materials and/or sealants can be used to bond and/or lightly seal the wall membrane 458 to the wall 430 and/or the joist pocket assembly 400. In some examples a first sealant 459 and a second sealant 460 can be used to bond and/or tightly seal the wall membrane 458 to the wall 430 and/or the joist pocket assembly 400. In some embodiments, the wall membrane 458 and/or first and/or second sealants 459, 460 either alone or in combination can be configured to provide a moisture and/or vapor barrier and provide thermal insulation for the refrigerated facility 401. As shown, the first and/or second sealant can be located between the wall membrane 458 and the wall 430. In some examples, the first sealant 459 can be placed just above the joist pocket assembly 400 and the second sealant 460 can be placed just below the joist pocket assembly 400. In some examples a third sealant 463, located between the wall membrane 458 and the insulated metal panel 442, can be used to bond and/or tightly seal the wall membrane 458 to the wall 430, insulated metal panel 442, and/or the joist pocket assembly 400. In some examples, the third sealant 463 can be a field applied continuous bead of non-skinning butyl sealant which is placed in a groove and/or joint allowing for bonding with the wall membrane 458 and/or another butyl sealant. In some examples, the first, second and/or third sealants 459, 460, 463 can include a butyl sealants, a tape and/or a butyl tape. In some examples, bonding and/or sealing the wall membrane 458 to the wall 430 and/or the joist pocket assembly 400 can prevent moisture and/or vapor from entering or escaping the refrigerated facility 401. In some examples, bonding and/or sealing the wall membrane 458 to the wall 430, insulated metal panel 442 and/or the joist pocket assembly 400 can prevent cold air from escaping and/or prevent thermal insulation loss for the refrigerated facility 401. In some embodiments, the first, second and/or third sealants 459, 460, 463 can be applied discretely. In an example, the first, second and/or third sealants 459, 460, 463 can be applied in one, two or more separate applications, e.g., as beads of sealant, different and/or separate cut portions of tape, among other discrete applications of the sealants 459, 460, 463. In some embodiments, the first, second and/or third sealants 459, 460, 463 can be applied continuously. In one example, the first and second sealants 459, 460 can be a continuous layer of sealant. In an example, the first, second, and/or third sealants 459, 460, 463 can include a continuous layer of butyl tape. In some embodiments, the wall membrane 458 can be adhered and/or bonded to the joist pocket assembly 400, the wall 430 and/or the insulated metal panel 442 by hot air welding. Although one wall membrane 458 is shown, in some embodiments, one or more wall membranes can be used (e.g., a first wall membrane, a second wall membrane, etc.). In some embodiments, the wall membrane 458 and the roof membrane 456 can be the same material and/or include similar materials, e.g., thermoplastic polyolefin (TPO), among others. In some embodiments, the wall membrane 458 and the roof membrane 456 can be made up of different materials.

In some embodiments, the roof membrane 456 and the wall membrane 458 together can collectively be referred to herein as a membrane material. In some embodiments, the membrane material be disposed between the insulated metal panel 442, roof insulation 454, and insulation material 440.

In some embodiments, the membrane material can be disposed over the wall 430, insulated metal panel 442 and/or the roof 450.

Figure 5:
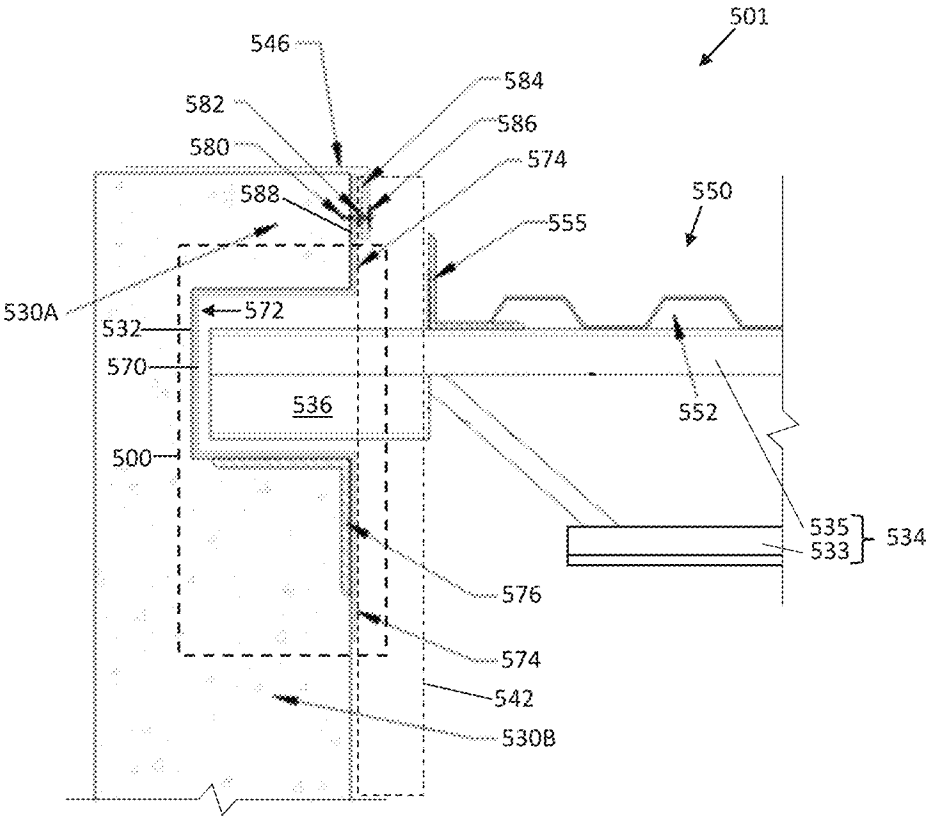
FIG. 5 illustrates another exemplary joist pocket assembly in a refrigerated facility, according to some embodiments.

Referring to FIG. 5, a cross-sectional view of another joist pocket assembly in a refrigerated facility is presented, according to some embodiments. As described above, like reference numbers used for features described can be used to represent the same or similar features shown. For example, a joist 534 of FIG. 5 can refer to the same or similar joist 434 shown and described in FIGS. 4A and 4B.

Referring again to FIG. 5, in some embodiments, in contrast to the joist pocket assembly 400 having a frame 402 in FIGS. 4A and 4B, a joist pocket assembly 500 that does not make use of a frame is presented. In place of a frame, in some embodiments, the joist pocket assembly 500 of a refrigerated facility 501 can include an vapor barrier 570 which can be applied directly to the a wall 530. In some examples, and as described above, the vapor barrier 570 can include a material configured to prevent and/or slow the transfer of water vapor across external surfaces of the refrigerated facility 501. In some examples, vapor barrier 570 can include a roofing membrane material, one or more insulated metal panels and/or an under floor material. In some examples, the vapor barrier can include one or more of sealants, adhesives and/or any other type of bonding materials. As used herein, the wall 530 can include a top portion 530A and a bottom portion 530B, where the wall portions 530A, 530B collectively can be referred to as the wall 530. In an example, the top portion 530A of the wall 530 can match a height of a roof 550 of the refrigerated facility 501. The vapor barrier 570 can be, in an example, applied onto the inside and/or around a cut-out portion 532 of the wall 530. The vapor barrier 570 can be, for example, applied inside 572 of the cut-out portion 532. The vapor barrier 570, in some examples, can be applied outside of the cut-out portion 532, along the wall 530 at locations 574, as shown. In an example, the vapor barrier 570 can be applied inside 572 of the cut-out portion 532 and extend outside 574 of the cut-out portion to the outer sides of the wall 530. In some examples, the vapor barrier 570 can be painted onto the wall 530. In one example, the vapor barrier 570 can be referred to herein as an applied vapor barrier, painted vapor barrier, among other terms. In some embodiments, the joist pocket assembly 500 can be formed into the concrete of the wall 530, e.g., within the cut-out portion 532. The joist pocket assembly 500, in one embodiment, can include a joist bearing plate 576. In some examples, the joist bearing plate 576 can be formed and/or built into the wall 530. The joist bearing plate 572 can be, in some examples, configured to provide additional structural support between the overlying joist 534 and an underlying portion of the wall 530. In some embodiments, the vapor barrier 570 can be placed over the joist bearing plate 576. In some examples, the vapor barrier 570 can extend past the joist bearing plate 576. The vapor barrier 570, in an example, can entirely cover and/or be applied over the joist bearing plate 576.

Referring again to FIG. 5, in some embodiments, the refrigerated facility 501 can include a roof membrane 546. In some embodiments, the roof membrane 546 can be coupled to and/or fastened to the wall 530. In some embodiments, the roof membrane 546 can be fastened to the wall 530 using one or more of an adhesive, bonding, and/or mechanical elements. For example, the roof membrane 546 can be coupled to the wall 530 using a nail, tape, and/or an applied adhesive. The roof membrane 546, in some examples, can be fastened to the wall 530 using a zinc nail 580 and/or a sealing mastic tape 582. A seam tape 584 and/or a terminator bar 586, in some examples, can be used to adhere and/or keep the roof membrane fastened to the wall 530. In some examples, the nail 580 and/or tape 582 can be fastened to one side 588 of the wall 530 only. In some embodiments, the roof membrane 546 can include plastic, polyvinyl chloride (PVC), ethylene propylene diene monomer (EPDM) and/or thermoplastic. In some embodiments, the roof membrane 546 can include thermoplastic polyolefin (TPO).

Figure 6:
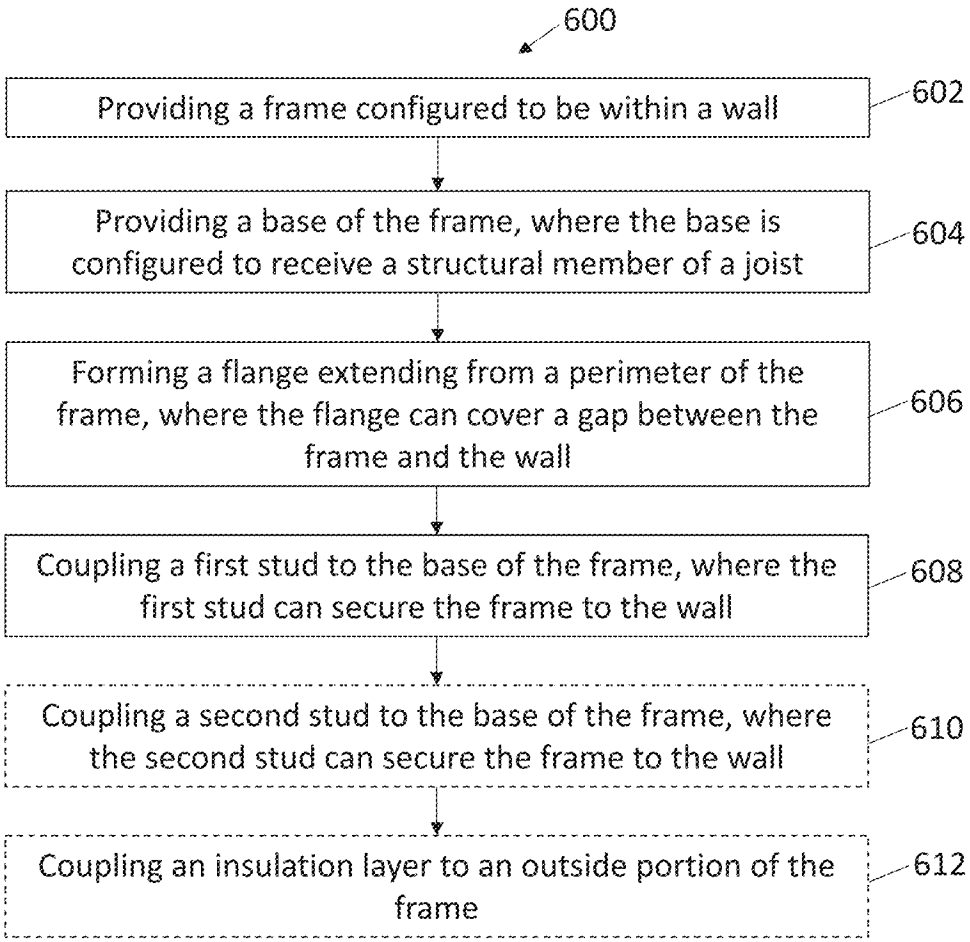
FIG. 6 illustrates a flowchart of a method for manufacturing a joist pocket assembly, according to some embodiments.

Referring to FIG. 6, a method 600 for manufacturing a joist pocket assembly is presented, according to some embodiments. At step 602, the method of manufacturing a joist pocket assembly can include providing a frame configured to be within a wall. At step 604, the method of manufacturing a joist pocket assembly can include providing a base of the frame, where the base is configured to receive a structural member of a joist. At step 606, the method of manufacturing a joist pocket assembly can include forming a flange extending from a perimeter of the frame, where the flange can cover a gap between the frame and the wall. At step 608, the method of manufacturing a joist pocket assembly can include coupling a first stud to the base of the frame, where the first stud can secure the frame to the wall. In some embodiments, the wall can be part of a refrigerated facility. At an optional step 610, the method of manufacturing a joist pocket assembly can include coupling a second stud to the base of the frame, where the second stud can secure the frame to the wall. At an optional step 612, the method of manufacturing a joist pocket assembly can include coupling an insulation layer to an outside portion of the frame. In some embodiments, coupling the insulation layer can include coupling at least one of a rigid polyiso foam, extruded polystyrene (XPS), expanded polystyrene (EPS), sprayable polyurethane, or polyisocyanurat to an outside portion of the frame.

Figure 7:
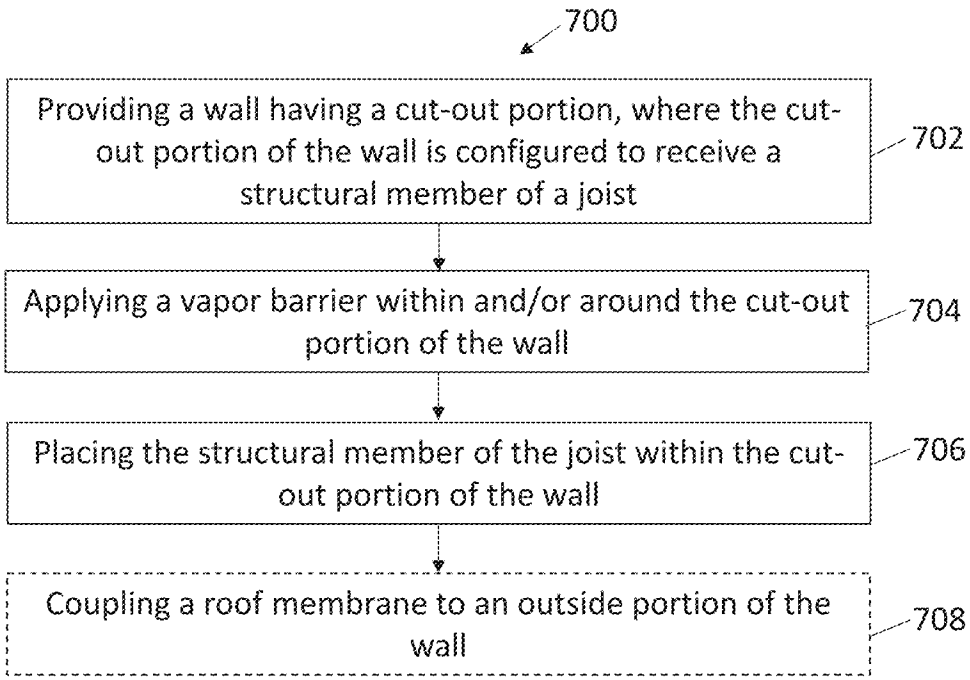
FIG. 7 illustrates a flowchart of a method for forming a joist pocket assembly onto a wall of a refrigerated facility, according to some embodiments.

Referring to FIG. 7, a method 700 for forming a joist pocket assembly onto a wall of a refrigerated facility is presented, according to some embodiments. At a step 702, the method can include providing a wall having a cut-out portion, where the cut-out portion of the wall is configured to receive a structural member of a joist. At a step 704, the method can include applying a vapor barrier within and/or around the cut-out portion of the wall. In some embodiments, applying a vapor barrier can include painting a vapor barrier. Applying the vapor barrier can include, in one embodiment, mounting a frame configured to be within the cut-out portion of the wall. At a step 706, the method can include placing the structural member of the joist within the cut-out portion of the wall. At an optional step 706, the method can include coupling a roof membrane to an outside portion of the wall. In some embodiments, the roof membrane can include plastic, polyvinyl chloride (PVC), ethylene propylene diene monomer (EPDM) and/or thermoplastic. In some embodiments, the roof membrane can include thermoplastic polyolefin (TPO).

Terminology

The phraseology and terminology used herein is for the purpose of description and should not be regarded as limiting.

The term "approximately", the phrase "approximately equal to", and other similar phrases, as used in the specification and the claims (e.g., "X has a value of approximately Y" or "X is approximately equal to Y"), should be understood to mean that one value (X) is within a predetermined range of another value (Y). The predetermined range may be plus or minus 20%, 10%, 5%, 3%, 1%, 0:1%, or less than 0.1%, unless otherwise indicated.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A joist pocket assembly, comprising:

a frame configured to be mounted within a cut-out in a wall;

a base of the frame, wherein the base is configured to receive a structural member of a joist;

a flange extending from a perimeter of the frame, wherein the flange covers a gap between the frame and the wall;

a first stud coupled to the base of the frame, wherein the first stud secures the frame to the wall; and an insulated metal panel coupled to the joist pocket assembly, wherein the insulated metal panel is adjacent to the wall; and one or more of an insulation fill disposed between the joist pocket assembly, the insulated metal panel and the wall, and a wall membrane disposed between the joist pocket assembly, the insulated metal panel, and the wall.

2. The joist pocket assembly of claim 1, wherein the wall is part of a refrigerated facility.

3. The joist pocket assembly of claim 1, further comprising a second stud coupled to the base of the frame, wherein the second stud secures the frame to the wall.

4. The joist pocket assembly of claim 1, wherein the flange extends approximately 2 inches from the perimeter of the frame.

5. The joist pocket assembly of claim 1, wherein the frame comprises a shape of at least one of a square, rectangle, circle, triangle, or polygon.

6. The joist pocket assembly of claim 1, wherein the insulation fill comprises at least one of a rigid polyiso foam, extruded polystyrene (XPS), expanded polystyrene (EPS), sprayable polyurethane, or polyisocyanurate.

7. The joist pocket assembly of claim 1, wherein the insulation fill comprises a foam-in-place insulation material.

8. The joist pocket assembly of claim 1, further comprising a sealant disposed between the joist pocket assembly, the wall, and the wall membrane, wherein the sealant bonds the wall membrane to the joist pocket assembly and the wall.

9. The joist pocket assembly of claim 8, wherein the sealant comprises a butyl sealant.

10. A method of manufacturing a joist pocket assembly, the method comprising:

providing a frame configured to be placed within a wall;

providing a base of the frame, wherein the base is configured to receive a structural member of a joist;

forming a flange extending from a perimeter of the frame, wherein the flange covers a gap between the frame and the wall;

coupling a first stud to the base of the frame, wherein the first stud secures the frame to the wall; and providing an insulated metal panel configured to be placed adjacent to the wall, wherein the insulated metal panel is configured to be coupled to the joist pocket assembly; and one or more of applying an insulation fill to the joist pocket assembly, wherein the insulation fill is configured to be disposed between the joist pocket assembly, the insulated metal panel, and the wall, and applying a wall membrane to the joist pocket assembly, wherein the wall membrane is configured to be disposed between the joist pocket assembly, the insulated metal panel, and the wall.

11. The method of claim 10, wherein the wall is part of a refrigerated facility.

12. The method of claim 10, further comprising coupling a second stud to the base of the frame, wherein the second stud secures the frame to the wall.

13. The method of claim 10, wherein the insulation fill comprises at least one of a rigid polyiso foam, extruded polystyrene (XPS), expanded polystyrene (EPS), sprayable polyurethane, or polyisocyanurate.

14. A joist pocket assembly, comprising:

a frame configured to be mounted within a cut-out within a wall, wherein the frame is in a shape of a square;

an opening in the frame, wherein the opening is configured to receive an structural member of a joist;

a base of the frame, wherein the base is configured to receive the structural member of the joist;

a flange extending from a perimeter of the frame, wherein the flange covers a gap between the frame and the wall; and a plurality of studs coupled to the base of the frame, wherein the plurality of studs secure the frame to the wall; and an insulated metal panel coupled to the joist pocket assembly, wherein the insulated metal panel is adjacent to the wall; and one or more of an insulation fill disposed between the joist pocket assembly, the insulated metal panel, and the wall, and a wall membrane disposed between the joist pocket assembly, the insulated metal panel, and the wall.

* * * * *